US005508584A

United States Patent [19]

Tsai et al.

[11] Patent Number: 5,508,584

[45] Date of Patent: Apr. 16, 1996

[54] FLAT PANEL DISPLAY WITH FOCUS MESH

[75] Inventors: Chun-hui Tsai, Hsinchu; Tzung-zu Yang, Pingtung, both of Taiwan

[73] Assignee: Industrial Technology Research Institute, Hsinchu, Taiwan

[21] Appl. No.: 363,871

[22] Filed: Dec. 27, 1994

[51] Int. Cl.[6] ..... H01J 9/227

[52] U.S. Cl. ..... 313/497; 313/307; 313/309; 445/24

[58] Field of Search ..... 313/495, 496, 313/497, 307, 309, 336, 351; 445/24

[56] References Cited

U.S. PATENT DOCUMENTS

| | | | |
|---|---|---|---|
| 4,857,799 | 8/1989 | Spindt et al. | 313/495 |
| 4,970,430 | 11/1990 | Kamogawa et al. | 313/495 |
| 5,186,670 | 2/1993 | Doan et al. | 445/24 |
| 5,191,217 | 3/1993 | Kane et al. | 250/423 |
| 5,225,820 | 7/1993 | Clerc | 340/752 |
| 5,453,659 | 9/1995 | Wallace et al. | 313/495 |

*Primary Examiner*—Kenneth J. Ramsey

*Attorney, Agent, or Firm*—George O. Saile; Stephen B. Ackerman

[57] ABSTRACT

A field emission display with focus mesh, and the method of making such a display, is described. There is a glass substrate acting as a face for a faceplate of the display. A conductive layer is formed over the glass substrate. A focus mesh dielectric that is formed over the conductive layer comprises a pattern of intersecting lines formed perpendicularly to one another. A focus mesh conductor overlays the focus mesh dielectric. Phosphor elements are formed within and separated from the pattern of intersecting lines, and over the conductive layer. During operation of the display, a first voltage is applied to the conductive layer, and a second voltage is applied to the focus mesh conductor. The first and second voltages create an electric field that focuses electrons emitted from field emission microtips, located at the baseplate, on to the phosphor elements.

25 Claims, 7 Drawing Sheets

FLAT PANEL DISPLAY WITH FOCUS MESH

BACKGROUND OF THE INVENTION (1) Field of the Invention

The invention relates to field emission flat panel displays, and more particularly to structures and methods of manufacturing field emission displays that provide a focus mesh for such displays.

(2) Description of the Related Art

In display technology, there is an increasing need for flat, thin, lightweight displays to replace the traditional cathode ray tube (CRT) device. One of several technologies that provide this capability is field emission displays (FED). An array of very small, conical emitters is manufactured, typically on a glass substrate, and are addressed via a matrix of columns and lines. These emitters are connected at their base to a conductive cathode, and the tips of the emitters are surrounded by a second conductive surface usually referred to as the gate. When the proper voltages are applied to the cathode and gate, electrons emission occurs from the emitter tips, with the electrons attracted to a third conductive surface, the anode, on which there is cathodoluminescent material that emits light when excited by the emitted electrons, thus providing the display element. The anode is typically mounted in close proximity to the cathode/gate/emitter structure and the area in between is a vacuum.

FIG. 1 is a cross-sectional view of a portion of a field emission display. Column electrodes 12, also called the cathode, are formed on a baseplate 10, and have emitter tips 14 mounted thereon. The emitters are separated by insulating layer 16. A row electrode 18, or gate, with openings for the emitter tips, is formed on the insulating layer 16 and is formed perpendicular to the column electrodes. When electrons are emitted, they are attracted to conductive anode 22 and upon striking phosphor 25 mounted on the anode, light is emitted, which can be viewed through the transparent faceplate 24.

When electrons are emitted from emitter tip 14, they disperse as shown by lines 26. The radius of the spot size 28 is determined by the equation $$r=\sqrt{2V_{gc}/V_a} * d$$

where $V_{gc}$ is the cathode-to-gate voltage, $V_a$ is the anode voltage, and d is the distance 30 from the gate to the anode. Two important design considerations place opposing requirements on the gate to anode distance d. Throughput is increased by a larger d because the gas contained between the anode and cathode is easier to pump out. However, to provide higher display resolution a smaller spot size is desirable, and, given the equation above, a smaller distance d is needed.

Workers in the art are aware of these problems and have attempted to resolve them, by adding structures to the FIG. 1 display to focus the emitted electrons onto a smaller spot size. In one approach, such as in U.S. Pat. No. 5,186,670 (Doan et al.), another conductive surface called a focus ring, or focus gate, is added above, close to and parallel to the gate. Openings are formed above the emitters and above similar openings in the gate. When the proper voltage is applied to the focus ring, electrons emanating from the emitters are deflected into a collimated beam, However, this approach increases drive capacitance, thereby undesirably increasing power consumption. In addition, the local electric field (in the vicinity of the emitter tips) is reduced, leading to a reduction in emission current.

A second approach is disclosed in U.S. Pat. No. 5,225,820 (Clerc) in which focussing is effectively accomplished at the faceplate, in which there are three addressable anodes for each color pixel. By applying a high voltage to the anodes for which the phosphors are desired to be excited, the emitted electrons move only toward the desired anode. This approach also leads to increased power consumption because of the anode addressing voltage, which is usually several hundred volts, and this only improves the focus in a single direction, perpendicular to the anode strips.

A related problem in the manufacture of the anode plate of field emission displays, for color applications, has been that multiple masks are needed when forming the anode/phosphor structure. For example, U.S. Pat. No. 5,225,820 (Clerc) discloses the use of several masks to form the anode/phosphor structures (where there are three such structures for each display pixel) and the interconnecting lines by which the anode lines are addressed.

SUMMARY OF THE INVENTION

It is therefore an object of this invention to provide a field emission display with decreased spot size, increased throughput and reduced power consumption.

It is a further object of this invention to provide a field emission display with improved focus at the anode plate in all directions.

Another object of this invention is to provide a very manufacturable method of fabricating a field emission display with improved focus.

It is a still further object of this invention to provide a very manufacturable method of fabricating a field emission display using only a single mask for forming the anode/phosphor strips.

It is yet another object of the invention to provide a field emission display with narrowly spaced anode/phosphor strips.

These objects are achieved by a flat panel display having a baseplate, and a faceplate with focus mesh. There is a glass substrate acting as a face for the faceplate. A conductive layer is formed over the glass substrate. A focus mesh dielectric that is formed over the conductive layer comprises a pattern of intersecting lines formed perpendicularly to one another. A focus mesh conductor overlays the focus mesh dielectric. Phosphor elements are formed within and separated from the pattern of intersecting lines, and over the conductive layer. There is a means to provide a first voltage to the conductive layer. There is a means to provide a second voltage to the focus mesh conductor, whereby during operation of the flat panel display the first and second voltages create an electric field to focus electrons emitted from the field emission microtips on to the phosphor elements.

These objects are further achieved by a method for making a flat panel display having a baseplate and a faceplate with focus mesh. A glass substrate is provided to act as the base for the faceplate. A first conductive layer is formed over the glass substrate. A first dielectric layer is formed over the first conductive layer. A second conductive layer is formed over the first dielectric layer. The second conductive layer and the first dielectric layer are patterned to form intersecting perpendicular lines to create the focus mesh. Phosphor elements are formed within and separated from the pattern of intersecting lines, and over the first conductive layer. The faceplate with focus mesh is mounted opposite to and parallel to the baseplate which has a plurality of field emission microtips extending up from a substrate through openings formed in a sandwich structure of a second insulating layer and a third conductive layer.

These objects are further achieved by a method of making a field emission display having a faceplate by using a single mask, and having a focus mesh. A glass substrate is provided to act as the base for the faceplate. A first conductive layer is formed over the glass substrate. The first conductive layer is patterned, using the single mask, to create three separate conductive structures, comprising a first combed structure, a second combed structure interlocking with the first combed structure, and an interweaving structure located between the first and second combed structures. A layer of first phosphorescent material is formed over the first combed structure. A layer of second phosphorescent material is formed over the second combed structure. A layer of third phosphorescent material is formed over the interweaving structure. A first dielectric layer is formed over the first and second combed structure and the interweaving structure. A second conductive layer is formed over the first dielectric layer. The second conductive layer and the first dielectric layer are patterned to form intersecting perpendicular lines to create the focus mesh. The faceplate with focus mesh is mounted opposite to and parallel to the baseplate which has a plurality of field emission microtips extending up from a substrate through openings formed in a sandwich structure of a second insulating layer and a third conductive layer.

These objects are still further achieved by a field emission display having a baseplate and a faceplate with focus mesh. A glass substrate acts as a face for the faceplate. A first combed conductive structure, a second combed conductive structure interlocking with the first combed conductive structure, and an interweaving conductive structure located between the first and second combed conductive structures, are all formed over the glass substrate. There is a first layer of phosphorescent material over the first combed conductive structure. There is a second layer of phosphorescent material over the second combed conductive structure. There is a third layer of phosphorescent material over the interweaving conductive structure. A focus mesh dielectric is formed over the conductive layer and comprises a pattern of intersecting lines formed perpendicularly to one another. There is a focus mesh conductor over the focus mesh dielectric. There is a means to provide a first voltage to the conductive structures. There is a means to provide a second voltage to the focus mesh conductor, whereby during operation of the flat panel display the first and second voltages create an electric field to focus electrons emitted from the field emission microtips on to the layers of phosphorescent material.

DESCRIPTION OF THE PREFERRED EMBODIMENTS

Figure 2:
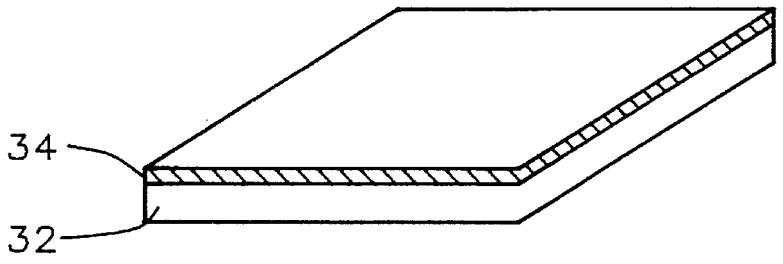
FIGS. 2 to 4 are a three-dimensional representation of a method, and resultant structure, of the invention for forming an anode plate with focus mesh for a field emission display.

Referring now to FIGS. 2 to 6, a method for forming a focus mesh for a flat panel display, and the resultant structure, will be described. As shown in FIG. 2, a transparent glass plate 32 is provided, having a thickness of between about 1 and 10 millimeters. A conductive layer 34 of indium tin oxide (ITO) is sputtered on the glass plate 32, to a thickness of between about 500 and 1000 Angstroms.

Figure 3:
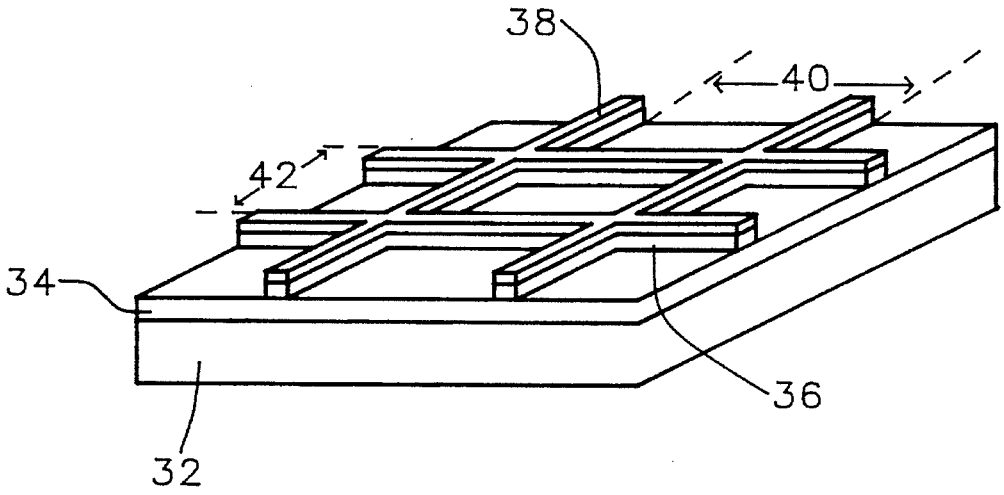
Figure 4:
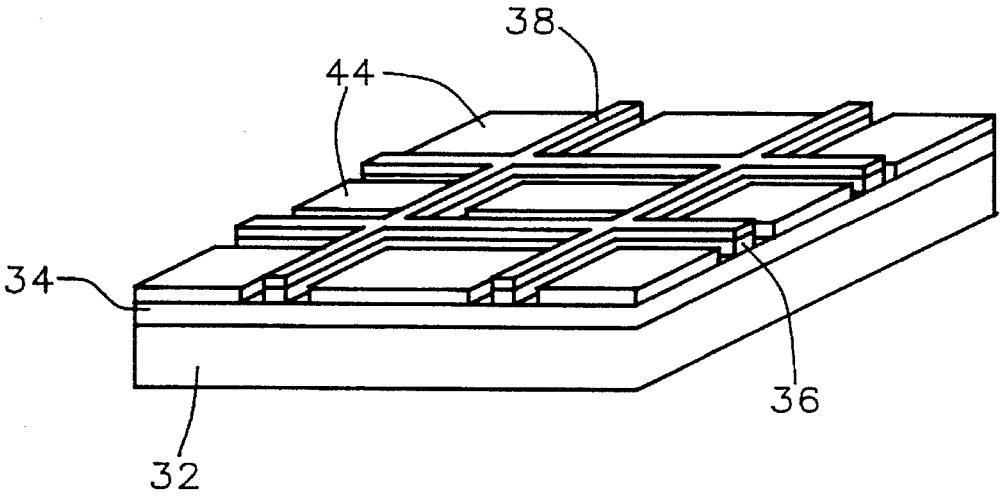

Referring now to FIGS. 3 and 4, the critical step of forming the focus mesh is described. A focus mesh dielectric 36 is formed on ITO layer 34, with a focus mesh conductor 38 formed on the dielectric. This is accomplished either by screen printing or deposition and lithography techniques. For screen printing, glass frit is used to form first dielectric layer 36 and is then sintered. Mesh conductor 38, which is formed of Al (aluminum), Ni (nickel), Cu (copper) or the like, is printed on layer 36 after the sintering. Alternately, layer 36 formed of $SiO_2$ (silicon oxide) or $Si_3N_4$ (silicon nitride) may be deposited by CVD (chemical vapor deposition), followed by deposition of layer 38 formed of Al, Ni or Mo (molybdenum) and deposited by sputtering. These two layers would then be patterned by conventional lithography and etching to give the focus mesh pattern of intersecting lines shown in FIG. 3.

The dielectric 36 is formed to a thickness of between about 10 and 50 micrometers. This thickness is important because the dielectric layer must be sufficiently thick to prevent breakdown between the conductor 38 and ITO layer 34 during display operation. The voltage difference during operation is on the order of several hundred volts. The thickness of conductor 38 is not critical, and depends on which coating method is used—the thickness is between about 10 and 50 micrometers using screen printing, and between about 1000 and 2000 Angstroms when sputtered on. The distances 40 and 42 between the focus mesh lines are between about 100 and 500 micrometers, with this size being dependent on the pixel size of the display.

After completion of the focus mesh, phosphor elements 44 are formed over ITO layer 34 and between the focus mesh lines, as shown in FIG. 4. The phosphor is deposited by electrophoresis. A DC (direct current) voltage bias is applied to ITO 34 where deposition is desired. For a color display, three different phosphors are deposited that separately emit red, green and blue light. Three distinct electrophoresis steps would thus be required, one for deposition of each phosphor type. Electrophoresis is the motion of charged particles through a suspending medium under the influence of an applied electric field. The plate on which the phosphorescent materials are to be deposited is placed opposite another conductive plate, in a solution in which the materials are suspended and in which these materials are charged by means, for example, of an ionizable electrolyte. The charged phosphorescent materials are attracted to the plate on which they are to be deposited by applying an electric field between the two plates. Further information may be found in U.S. Pat. No. 2,851,408 (Cerulli). The phosphor 44 is deposited to a thickness of between about 10 and 30 micrometers. During electrophoresis, ITO layer 34 is biased to a different potential than conductor 38, such that a gap 46 is formed between the phosphor elements 44 and the focus mesh.

Figure 5:
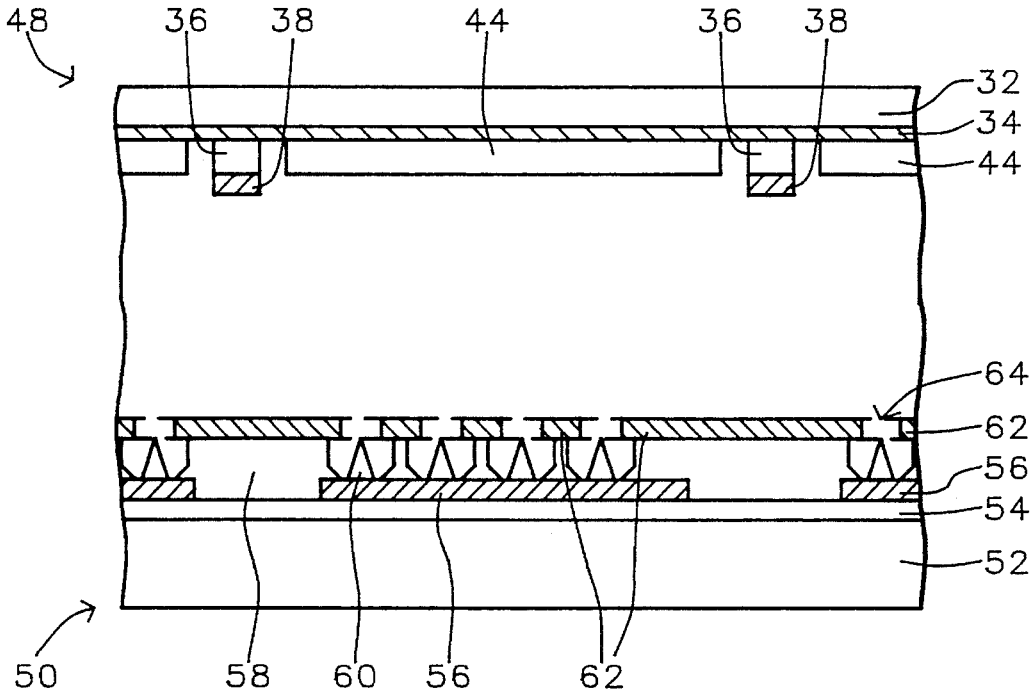
FIG. 5 is a cross-sectional representation of the anode plate with focus mesh of the invention mounted opposite a base plate with field emission tips to form a field emission display.

With reference to FIG. 5, the faceplate 48 on which the focus mesh is formed is mounted opposite and parallel to a baseplate on which has already been formed field emission microtips 60, on substrate 52, in openings 64. The gate layer 62 is separated from the conductive cathode 56 by an insulating layer 58 and controls electron emission when a proper voltage bias is applied. The conductive cathodes 56 are separated from the substrate 52 by a buffer layer 54. The formation of the baseplate and emitters will not be described in detail as it is known in the art and is not significant to the invention. Many thousands, or even millions, of microtips are formed simultaneously on a single baseplate in the formation of a field emission display. The faceplate 48 and baseplate 50 are mounted to and separated by spacers (not shown) that keep the opposing plates a constant distance apart across the entire display surface.

A pixel is defined as the intersection of a gate line and a cathode conductor, which are formed perpendicular to one another. The number of emitters 60 that are formed at a single location varies from one emitter to (more commonly) many emitters, the latter to provide redundant operation. Each pixel of emitters is mounted opposite a phosphor element 44, as shown in FIG. 5. As is known in the art, the phosphor element 44 may be a set of three elements, each one having a different phosphor for use in a color display application.

Figure 1:
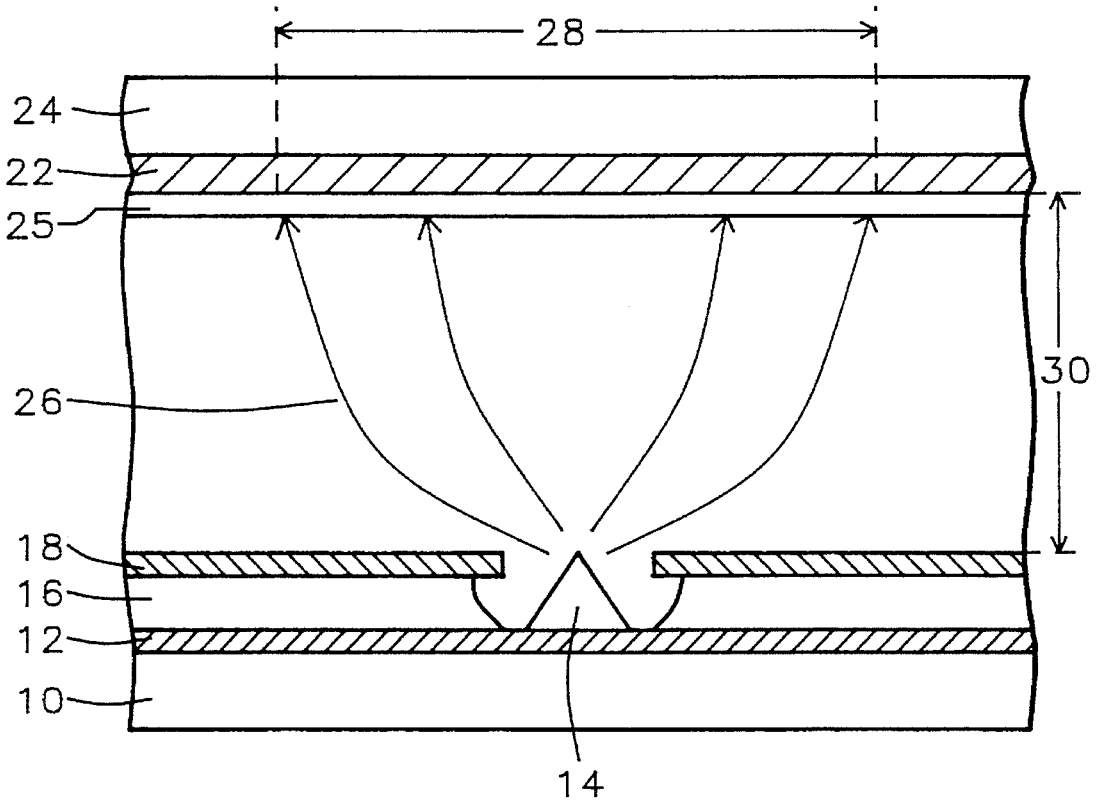
FIG. 1 is a cross-sectional representation of a related art field emission display having no focus structure.
Figure 6:
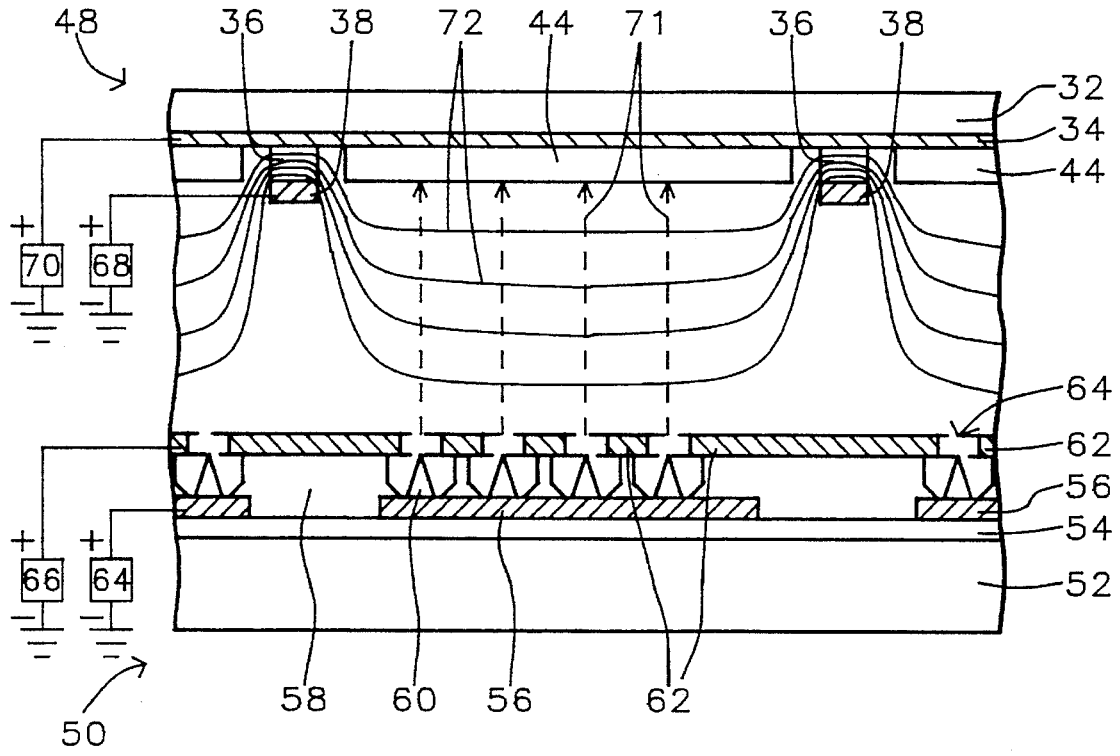
FIG. 6 is a cross-sectional representation of operation of the field emission display of FIG. 5.

The operation of the structure of the invention having a focus mesh is depicted in FIG. 6. Voltage sources 64 and 66 are connected to the cathode 56 and gate 62, respectively. A difference in voltage potential, typically between about 40 and 80 volts, between the gate and cathode will cause the field emitters 60 to emit electrons 71 from their tips. A voltage source 70 is connected to ITO layer 34, acting as an anode with an anode voltage typically between about 200 and 1000 volts. Emitted electrons are attracted to the anode and strike the phosphor elements 44 to cause light emission. Without the focus mesh of the invention, the electron path would be dispersive as shown in FIG. 1, with the resultant spot size dependent primarily on the distance between the opposing face and base plates of the field emission display. By using the focus mesh, and applying a low DC voltage (ground, or approximating the gate voltage) using source 68, an electric field 72 is created in the space between the display plates. Due to this electric field distribution, emitted electrons will be focused onto the desired phosphor elements in a narrower beam than would otherwise occur.

Beside the decreased spot size the method of the invention provides, thus increasing the display resolution, the invention also requires less of an increase in power consumption than other known focussing techniques, since there is no additional drive capacitance, and the voltages at the anode and focus mesh are DC. Furthermore, increased throughput is possible since the distance between the opposing plates can be increased without a detrimental effect on the spot size. The focus mesh of the invention also gives a two-dimensional focus improvement as opposed to the improvement in only one direction of the related art.

Figure 7:
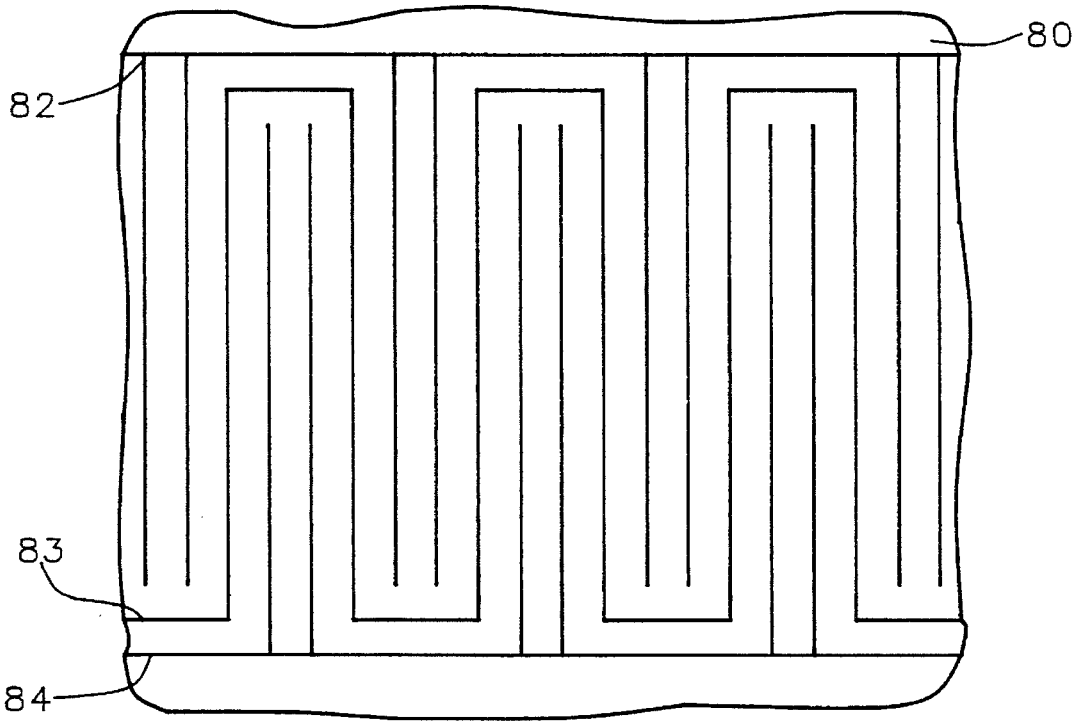
FIGS. 7 and 8 are a top view of an anode faceplate formed using a second method of the invention for a field emission display with focus mesh.
Figure 8:
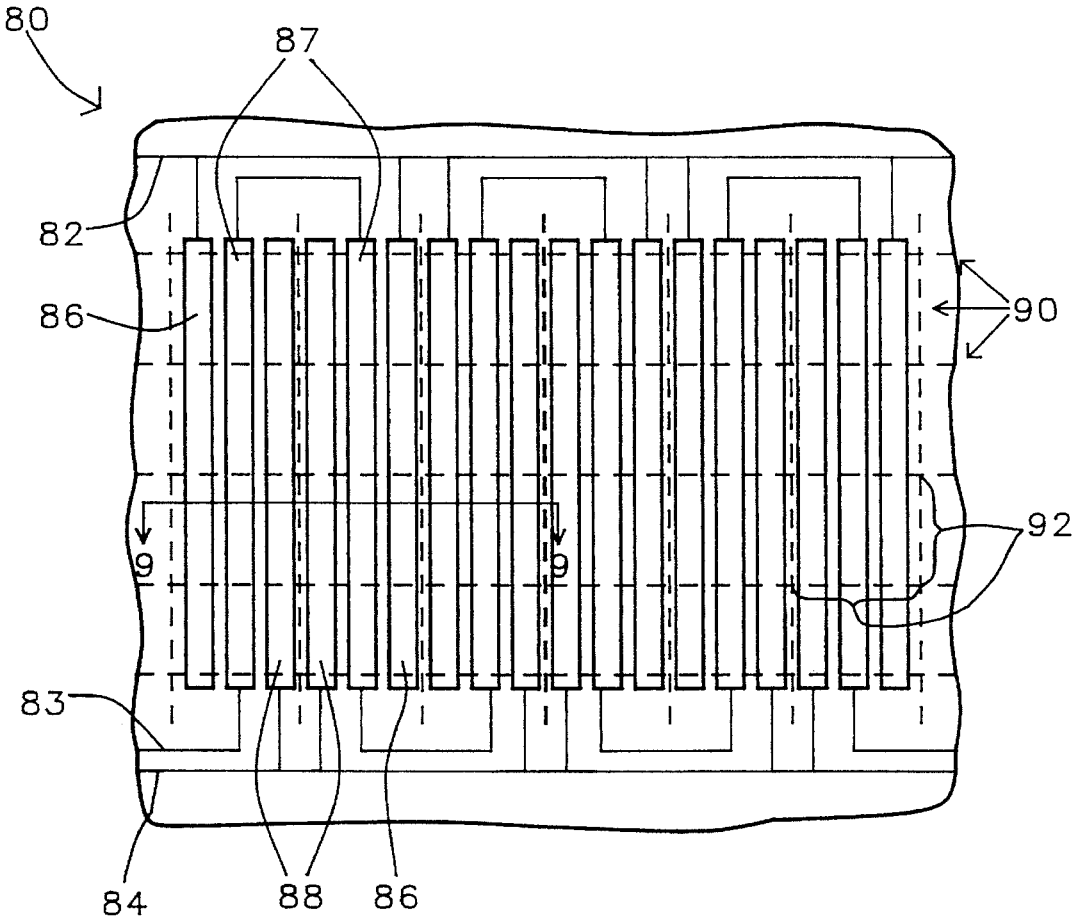
Figure 9:
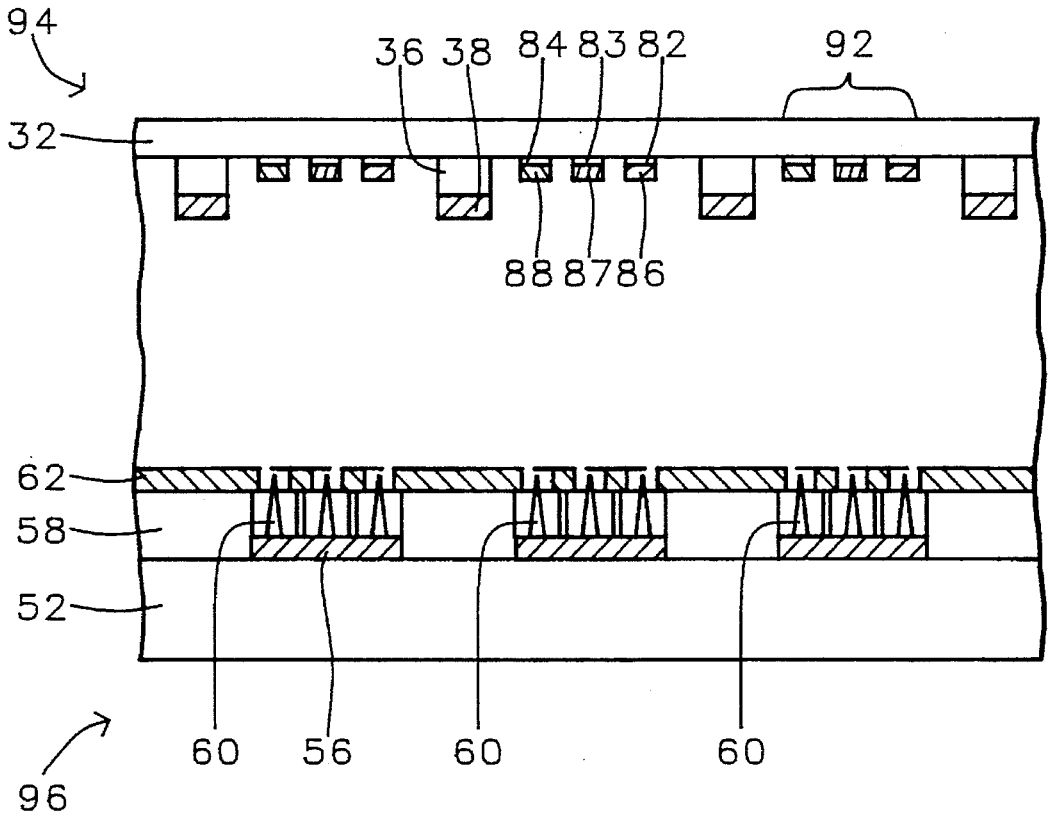
FIG. 9 is a cross-sectional representation of the resultant structure using the second method of the invention, where the anode faceplate of FIG. 9 is taken along line 9—9 of FIG. 8.

A second structure of the invention, and a method for manufacturing such a structure, is now described with respect to FIGS. 7 to 9. Referring to the FIG. 7 top view, an anode plate with three sets of phosphor elements is shown, as would be used in a color display having red, green and blue phosphors. A conductive material such as indium tin oxide is formed as a layer on a glass plate 80, as in the first method of the invention.

In a critical set of steps of this method of the invention, this layer is patterned, using conventional lithography and etching, into three conductive lines 82, 83 and 84. Conductive lines 82 and 84 have a comb-like shape while line 83 has an interweaving shape, wherein all three lines are interlocking, as shown schematically in FIG. 7. These lines are formed to a width of between about 30 and 100 micrometers. A focus mesh 90 is then formed in the pattern shown schematically in FIG. 8, over the phosphor elements, using the same method as described earlier.

The three sets of phosphors are then formed on the conductive lines by electrophoresis, and in a critical distinction from the prior art, this is accomplished using a single mask. In the areas of the anode plate in which phosphor is desired to be deposited, a single mask is used whereby phosphor patterns 86, 87 and 88, as shown in FIG. 8, may be formed using red-light-emitting, green-light-emitting and blue-light-emitting phosphors, respectively. It will be understood by those familiar with the art, however, that the order of the phosphors could be changed without effecting the scope of the invention. A DC voltage bias would first be applied to conductive line 82 and electrophoresis, as described above, used to deposit a red-emitting phosphor such as $(Zn_{0.2},Cd_{0.8})S:Ag:Cl$ or $Y_2O_2S:Eu$, to form patterns 86. Two subsequent electrophoresis steps would be performed by applying a voltage to lines 83 and 84 and depositing green-emitting phosphor such as $(Zn_{0.8},Cd_{0.2})S:Ag:Cl$ or ZnS:Cu:Al, and blue-emitting phosphor such as ZnS:Ag:Cl, to form phosphor patterns 87 and 88, respectively.

The phosphor strips are separated by between about 10 and 50 micrometers. This method avoids the prior art packaging limitations in the density of the phosphor patterns because all three elements are connected out of the plate by lithography/etching, not by the package method.

After deposition of the phosphors, the anode faceplate 94 is mounted opposite the baseplate 96 in a similar manner as earlier described, and as shown in the cross-sectional view in FIG. 9, where the anode faceplate 94 is taken along line 9—9 of FIG. 8. Similar elements have the same reference characters as earlier used and described. Pixels 92 are shown in both FIGS. 8 and 9.

While the invention has been particularly shown and described with reference to the preferred embodiments thereof, it will be understood by those skilled in the art that various changes in form and details may be made without departing from the spirit and scope of the invention.

What is claimed is:

1. A flat panel display having a baseplate with field emission microtips, and a faceplate with focus mesh, comprising:

a glass substrate acting as a face for said faceplate;

a conductive layer over said glass substrate;

a focus mesh dielectric, formed over said conductive layer, comprising a pattern of intersecting lines formed perpendicularly to one another;

a focus mesh conductor, over said focus mesh dielectric;

phosphor elements, formed within and separated from said pattern of intersecting lines, and formed over said conductive layer;

a means to provide a first voltage to said conductive layer; and a means to provide a second voltage to said focus mesh conductor, whereby during operation of said flat panel display said first and second voltages create an electric field to focus electrons emitted from said field emission microtips on to said phosphor elements.

2. The flat panel display of claim 1 wherein said first voltage is greater than said second voltage.

3. The flat panel display of claim 1 wherein said first and second voltages are provided by direct current.

4. The flat panel display of claim 1 wherein each said phosphor element further comprises three separate strips of different phosphorescent material.

5. The flat panel display of claim 4 wherein said three separate strips are formed of red-light-emitting, green-light-emitting and blue-light-emitting phosphorescent material.

6. The flat panel display of claim 1 wherein said intersecting lines are separated by a distance of between about 100 and 500 micrometers.

7. The flat panel display of claim 1 wherein said focus mesh dielectric has a thickness of between about 10 and 50 micrometers.

8. A method for making a flat panel display having a baseplate with field emission microtips, and a faceplate with focus mesh, comprising the steps of:

providing a glass substrate to act as the base for said faceplate;

forming a first conductive layer over said glass substrate;

forming a first dielectric layer over said first conductive layer;

forming a second conductive layer over said first dielectric layer;

patterning said second conductive layer and said first dielectric layer to form intersecting perpendicular lines to create said focus mesh;

forming phosphor elements within and separated from said pattern of intersecting lines, and over said first conductive layer;

mounting said faceplate with focus mesh opposite to and parallel to said baseplate, which has a plurality of field emission microtips that extend up from a substrate through openings formed in a sandwich structure of a second insulating layer and a third conductive layer.

9. The method of claim 8 wherein said first conductive layer is formed of indium tin oxide having a thickness of between about 500 and 2000 Angstroms.

10. The method of claim 8 wherein said intersecting perpendicular lines are separated by a distance of between about 100 and 500 micrometers.

11. The method of claim 8 wherein said first dielectric layer is formed to a thickness of between about 10 and 50 micrometers.

12. The method of claim 8 wherein said phosphor elements are formed by electrophoresis, wherein a voltage bias is applied to said first conductive layer and said first conductive layer is exposed to phosphorescent material.

13. The method of claim 8 wherein said field emission microtips are formed in an array of pixels, wherein each pixel comprises at least one of said field emission microtips, and wherein each said pixel is mounted opposite to each of said phosphor elements on said faceplate.

14. A method of making a field emission display having a baseplate with field emission microtips, and a faceplate with focus mesh, using a single mask, comprising the steps of:

providing a glass substrate to act as the base for said faceplate;

forming a first conductive layer over said glass substrate;

patterning said first conductive layer, using said single mask, to create three separate conductive structures, comprising a first combed structure, a second combed structure interlocking with said first combed structure, and an interweaving structure located between said first and second combed structures;

forming a first dielectric layer over said first and second combed structure and said interweaving structure;

forming a second conductive layer over said first dielectric layer;

patterning said second conductive layer and said first dielectric layer to form intersecting perpendicular lines to create said focus mesh;

forming a layer of first phosphorescent material over said first combed structure;

forming a layer of second phosphorescent material over said second combed structure;

forming a layer of third phosphorescent material over said interweaving structure;

mounting said faceplate with focus mesh opposite to and parallel to said baseplate which has a plurality of field emission microtips extending up from a substrate through openings formed in a sandwich structure of a second insulating layer and a third conductive layer.

15. The method of claim 14 wherein said forming a layer of said first, second and third phosphorescent materials is by electrophoresis, further comprising the steps of:

applying a voltage bias to said first combed structure;

exposing said first combed structure to said first phosphorescent material;

applying a voltage bias to said second combed structure;

exposing said second combed structure to said second phosphorescent material;

applying a voltage bias to said interweaving structure; and exposing said interweaving structure to said third phosphorescent material.

16. The method of claim 14 wherein said first phosphorescent material emits red light, said second phosphorescent material emits blue light, and said third phosphorescent material emits green light, upon stimulation by electrons emitted from said field emission microtips.

17. The method of claim 14 wherein said first conductive layer is formed of indium tin oxide having a thickness of between about 500 and 2000 Angstroms.

18. The method of claim 14 wherein said intersecting perpendicular lines are separated by a distance of between about 100 and 500 micrometers.

19. The method of claim 14 wherein said first dielectric layer is formed to a thickness of between about 10 and 50 micrometers.

20. The method of claim 14 wherein said field emission microtips are formed in an array of pixels, wherein each pixel comprises at least one of said field emission microtips, and wherein each said pixel is mounted opposite to each of said phosphor elements on said faceplate.

21. A field emission display, having a baseplate with field emission microtips, and a faceplate with focus mesh, comprising:

a glass substrate acting as a face for said faceplate;

a first combed conductive structure, a second combed conductive structure interlocking with said first combed conductive structure, and an interweaving conductive structure located between said first and second combed conductive structures, all formed over said glass substrate;

a focus mesh dielectric, formed over said first, second, and interweaving conductive structures, comprising a pattern of intersecting lines formed perpendicularly to one another;

a focus mesh conductor, over said focus mesh dielectric;

a first layer of phosphorescent material over said first combed conductive structure;

a second layer of phosphorescent material over said second combed conductive structure;

a third layer of phosphorescent material over said interweaving conductive structure;

a means to provide a first voltage to said first, second, and interweaving conductive structures; and a means to provide a second voltage to said focus mesh conductor, whereby during operation of said flat panel display said first and second voltages create an electric field to focus electrons emitted from said field emission microtips on to said layers of phosphorescent material.

22. The field emission display of claim 21 wherein said first voltage is greater than said second voltage.

23. The field emission display of claim 21 wherein said layer of first phosphorescent material emits red light, said second layer of phosphorescent material emits blue light, and said third layer of phosphorescent material emits green light, upon stimulation by electrons emitted from said field emission microtips.

24. The field emission display of claim 21 wherein said intersecting lines are separated by a distance of between about 100 and 500 micrometers.

25. The field emission display of claim 21 wherein said focus mesh dielectric has a thickness of between about 10 and 50 micrometers.

* * * * *